US011673280B1

(12) United States Patent
Randall et al.

(10) Patent No.: US 11,673,280 B1
(45) Date of Patent: Jun. 13, 2023

(54) KNIFE LOCK

(71) Applicants: Jeffrey S. Randall, Gallant, AL (US); Michael B. Alford, Poolville, TX (US)

(72) Inventors: Jeffrey S. Randall, Gallant, AL (US); Michael B. Alford, Poolville, TX (US)

(73) Assignee: TransEquatorial Solutions Inc., Gallant, AL (US)

( * ) Notice: Subject to any disclaimer, the term of this patent is extended or adjusted under 35 U.S.C. 154(b) by 0 days.

(21) Appl. No.: 17/410,979

(22) Filed: Aug. 24, 2021

Related U.S. Application Data

(60) Provisional application No. 63/069,679, filed on Aug. 24, 2020.

(51) Int. Cl.
*B26B 1/04* (2006.01)

(52) U.S. Cl.
CPC ..... *B26B 1/04* (2013.01)

(58) Field of Classification Search
CPC .. B26B 1/04; B26B 1/044; B26B 1/00; B26B 1/02; B26B 1/042–048; B26B 1/10
USPC ..... 30/61
See application file for complete search history.

(56) References Cited

U.S. PATENT DOCUMENTS 5,685,079 A * 11/1997 Brothers et al. ..... B26B 1/04 30/155
7,905,022 B2 * 3/2011 Hawk ..... B26B 1/04 30/158
8,001,693 B2 * 8/2011 Onion ..... B26B 1/02 30/155
8,161,653 B2 * 4/2012 Nenadic ..... B26B 1/04 30/155
8,307,555 B2 * 11/2012 Onion ..... B26B 1/044 30/155
8,893,389 B2 * 11/2014 Freeman ..... B26B 1/046 30/155
9,061,426 B2 * 6/2015 Harvey ..... B26B 1/042
9,079,320 B2 * 7/2015 Onion ..... B26B 1/044
9,138,903 B2 * 9/2015 Vellekamp ..... B26B 1/02
9,908,245 B1 * 3/2018 Tkachenko ..... B26B 1/044
9,943,970 B2 * 4/2018 Glesser ..... B26B 1/048
10,695,920 B2 * 6/2020 Bruhns ..... B26B 1/044
10,870,209 B2 * 12/2020 Demko ..... B26B 1/048
11,453,133 B2 * 9/2022 Mayberry ..... B26B 1/046
2003/0070299 A1 * 4/2003 Frazer ..... B26B 1/048 30/160
2004/0045170 A1 * 3/2004 Glesser ..... B26B 1/04 30/155
2005/0194238 A1 * 9/2005 Frazer ..... B26B 1/048 200/48 A (Continued)

*Primary Examiner* — Jason Daniel Prone
*Assistant Examiner* — Richard D Crosby, Jr.
(74) *Attorney, Agent, or Firm* — Lightfoot & Alford PLLC

(57) ABSTRACT

A folding knife has a handle and a blade with a working end and a tang, the blade being coupled to the handle and pivotable relative to the handle about a fold axis between an open position and a closed position. A toggle is coupled to the handle and pivotable relative to the handle about a toggle axis, the toggle axis being located a radial distance from the fold axis. A free end of the toggle has an open lock face located a radial distance from the toggle axis. A primary lock face on the tang is located on the opposite side of the fold axis from the working end. When the blade is in the open position, the open lock face engages the primary lock face to prevent rotation of the blade toward the closed position.

19 Claims, 7 Drawing Sheets

(56) References Cited

U.S. PATENT DOCUMENTS

| | | | | |
|---|---|---|---|---|
| 2005/0262701 | A1* | 12/2005 | Lai | B26B 1/048 30/161 |
| 2009/0144986 | A1* | 6/2009 | Frazer | B26B 1/042 30/155 |
| 2009/0271989 | A1* | 11/2009 | VanHoy | B26B 1/044 30/159 |
| 2010/0299934 | A1* | 12/2010 | VanHoy | B26B 1/046 30/161 |
| 2011/0067246 | A1* | 3/2011 | Perez | B26B 1/044 30/158 |
| 2018/0133907 | A1* | 5/2018 | Kao | B26B 1/044 |
| 2020/0368925 | A1* | 11/2020 | Mayberry et al. | B26B 1/044 |

* cited by examiner

KNIFE LOCK

DETAILED DESCRIPTION

In the specification, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure divulges a new type of knife lock that incorporates an extended, secondary lock area, requiring additional motion before the blade is allowed to close.

Figure 1:
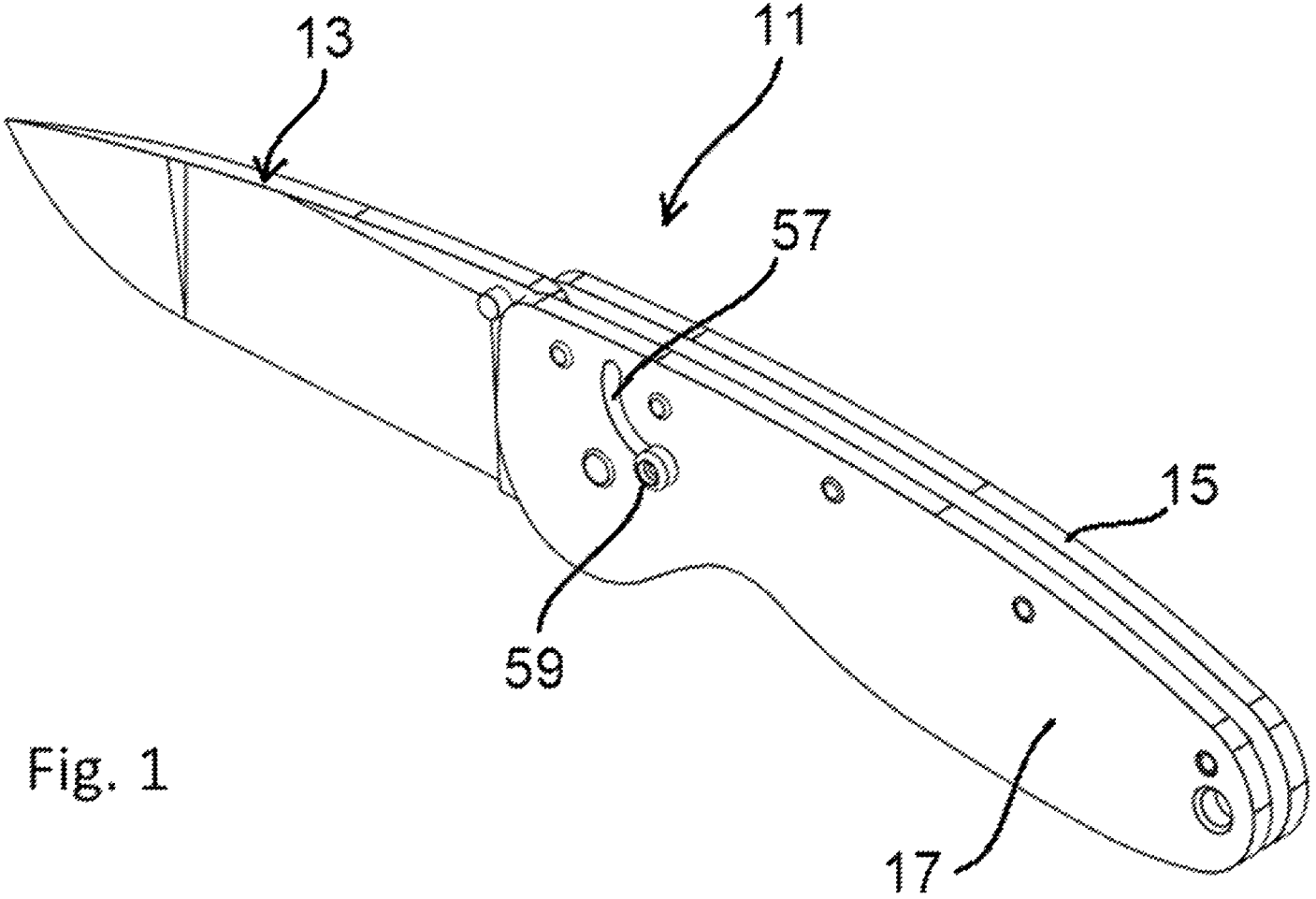
FIG. 1 is an oblique view of a knife with an embodiment of a lock according to this disclosure.
Figure 2:
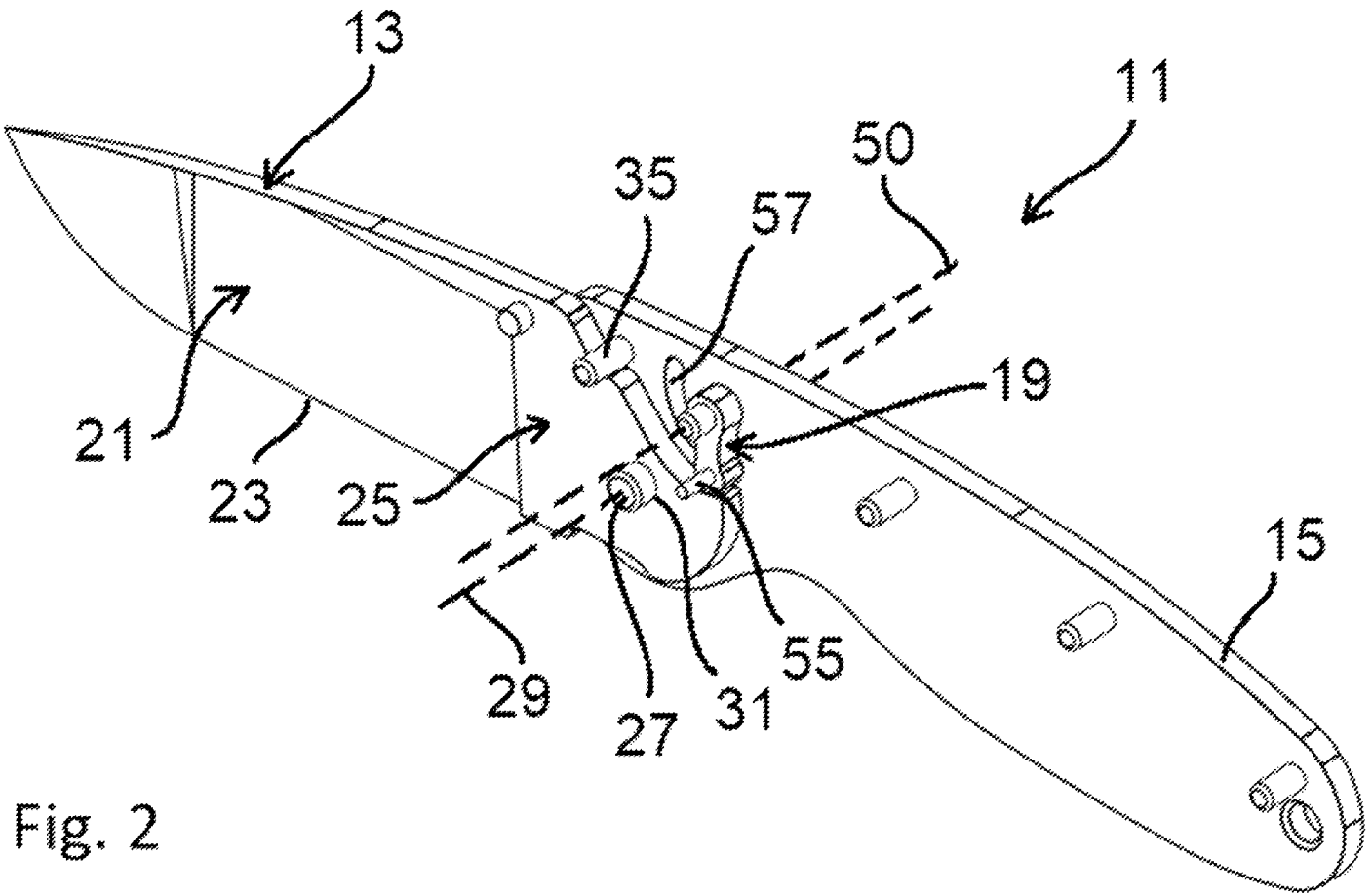
FIG. 2 is an oblique view of the knife of FIG. 1 with components removed for ease of viewing.
Figure 3:
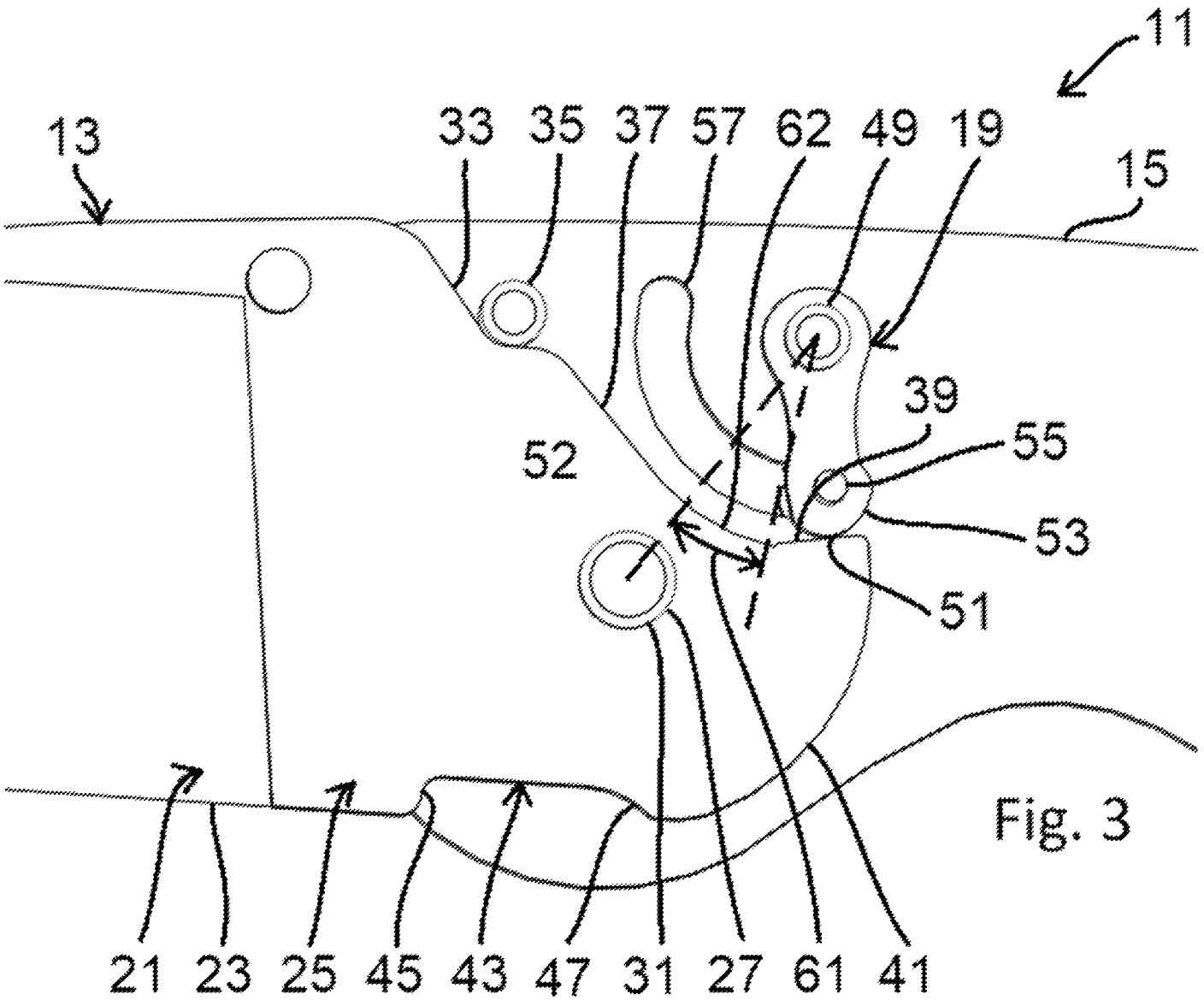
FIG. 3 is a side detail view of the lock of FIG. 1 with a blade of the knife in an open position.
Figure 4:
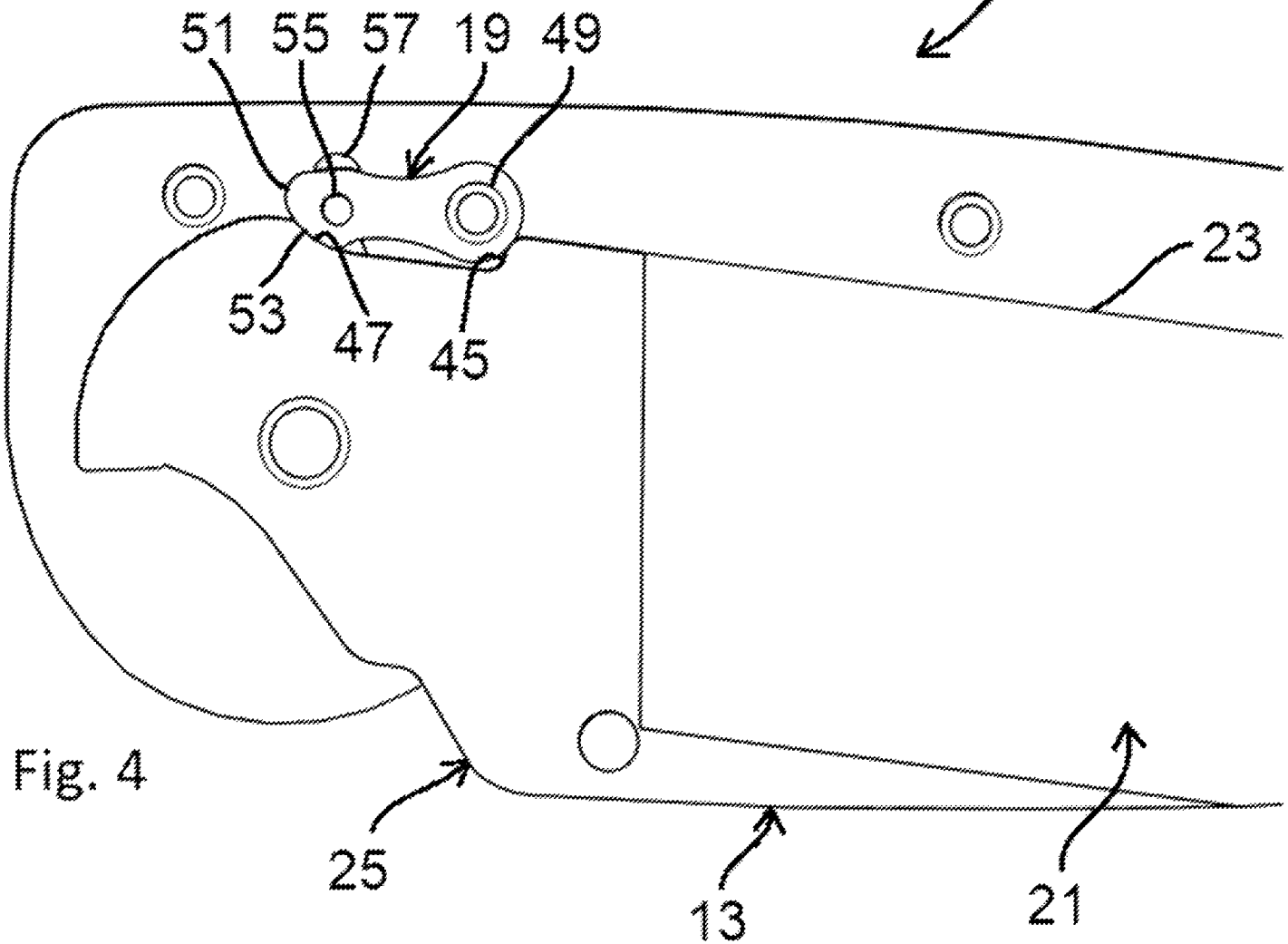
FIG. 4 is a side detail view of the lock of FIG. 1 with a blade of the knife in a closed position.

FIGS. 1 through 4 illustrate a folding knife 11 that incorporates an embodiment of a lock according to this disclosure. Knife 11 comprises a pivotable blade 13, handles 15, 17, and a toggle 19 housed between handles 15, 17. Knife 11 is designed to allow blade 13 to rotate between an open position, shown in FIGS. 1 through 3, and a closed position, as shown in FIG. 4. Blade 13 comprises a working portion 21 with sharpened edge 23 and a tang 25, and blade 13 is pivotable about blade pivot pin 27 on fold axis 29, pivot pin 27 extending through hole 31 formed in tang 25. In the closed position, edge 23 is located between handles 15, 17. Tang 25 comprises a stop pin surface 33 configured for engaging a stop pin 35 located between handles 15, 17 and used to prevent further rotation of blade 13 when blade 13 is moved to the open position. Tang 25 also comprises a clearance surface 37, a primary lock face 39, radial surface 41, and a recess 43 for receiving toggle 19 when blade 13 is in the closed position. Recess 43 has stop face 45 on one end and lock face 47 on the opposite end. Primary lock face 39 of tang 25 is located on the opposite side of fold axis 29 from working portion 21, and the forward end of face 39 is spaced a radial distance from fold axis 29.

In the embodiment shown, toggle 19 has a figure-8 shape and rotates at a pivot end on pivot pin 49 about toggle axis 50, which is spaced a radial distance from fold axis 29. A free end of toggle 19 comprises an open lock face 51, which is configured to engage primary lock face 39 when blade 13 is in the open position, and a closed lock face 53, which is configured to engage lock face 47 of tang 25 when blade 13 is in the closed position. A thumb stud 55 extends from at least one side of the free end and through an arcuate slot 57 formed in an adjacent handle 15, 17. In some embodiments, thumb studs 55 will extend from opposing sides of toggle 19 to allow for ambidextrous operation. A cap 59 may be installed on an outer end of each thumb stud 55 on an exterior of each handle 15, 17.

When blade 13 is in the open position shown in FIG. 3, stop pin surface 33 engages stop pin 35, preventing further rotation of blade 13. Also, the free end of toggle is rotated rearward, so that open lock face 51 engages primary lock face 39, preventing blade 13 from rotating away from the open position. Toggle 19 is biased by a spring or other device toward the position shown in FIG. 3 and to the rearward extent of slots 57. Primary lock face 39 may be formed with an angle, as shown, to allow for continued proper locking through additional rearward rotation of toggle 19 after wear occurs on lock face 39 of tang 25 or lock face 51 of toggle 19.

A secondary lock zone 61 is the angle between a forward end of primary lock face 39 and a plane 52 defined by fold axis 29 of blade 13 and toggle axis 50 of toggle 19. In preferred embodiments, the angle of lock zone 61 is between 5 and 35 degrees (inclusive). Secondary lock face 62 is the portion of surface 37 in zone 61 and is configured so that, when the free end of toggle 19 is within zone 61, lock face 51 of toggle 19 engages secondary lock face 62 for limiting rotation of blade 13 toward the closed position of FIG. 4. The biasing force on toggle 19 causes toggle 19 to rotate back toward the locked position of FIG. 3 if the user removes closing force applied to blade 13 and/or forward force applied to thumb studs 55.

To close blade 13, a user must apply sufficient forward pressure on thumb stud 55 to rotate toggle 19 to where lock face 51 is moved out of zone 61 and to the other side of plane 52, so that lock face 51 will not engage secondary lock face 62. This allows blade 13 to be rotated toward the closed position and for the remainder of clearance surface 37 and radial surface 41 to cause the free end of toggle 19 to rotate forward and upward toward the position shown in FIG. 4. In this closed position, blade 13 is prevented from further rotation by the contact of stop face 45 and the pivot end of toggle 19. In this embodiment, lock face 53 of toggle 19 engages lock face 47 of tang 25, preventing blade 13 from rotating away from the closed position and requiring the user to apply upward force to thumb studs 55 to disengage toggle 19 from blade 13.

Toggle 19 is shown with a figure-8, or "dog bone," configuration, but toggle 19 may have other shapes, including configurations with linear features. While shown as having thumb studs 55 protruding from toggle 19 and out of handles 15, 17, alternative embodiments can include recessed features that do not protrude from handles 15, 17, such as, for example, a dished area. Other alternative embodiments incorporate alternative toggle designs, links, levers, and/or similar components for actuating toggle 19, including versions that allow for reversing the direction of movement for unlocking toggle 19.

Figure 5:
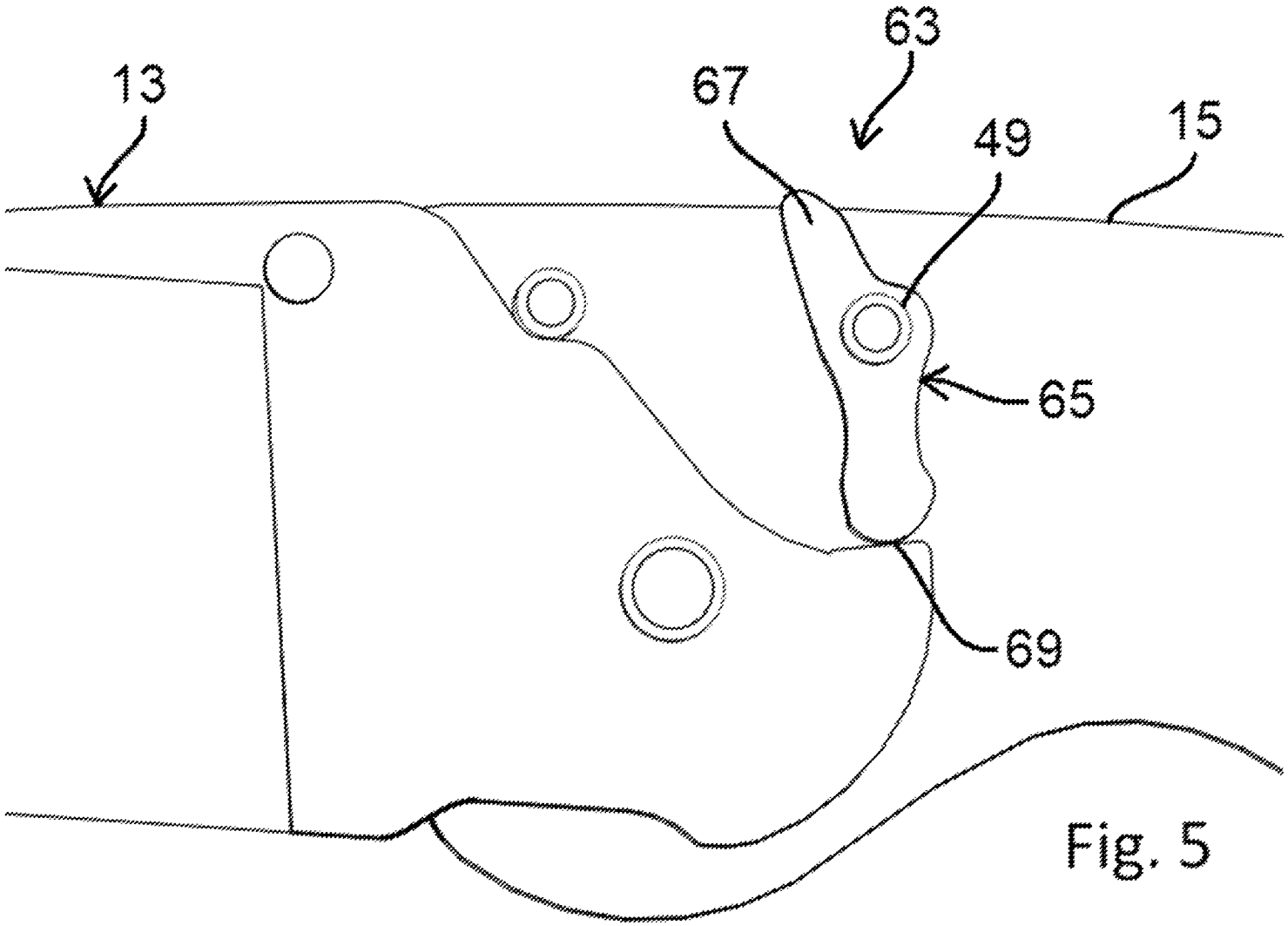
FIG. 5 is a side detail view of an alternative embodiment of a lock according to this disclosure.

For example, FIG. 5 illustrates an alternative embodiment, in which knife 63 comprises toggle 65. Toggle 65 is configured similarly to toggle 19, as described above, although toggle 65 lacks thumb studs 55 and incorporates a thumb lever 67 located on the end of toggle 65 opposite lock face 69. The outer end of lever 67 protrudes beyond the upper edge of handles 15,17 (17 not shown), both lacking slots 57. This allows a user to pull rearward on lever 67 to rotate toggle 65 and unlock blade 13.

Figure 6:
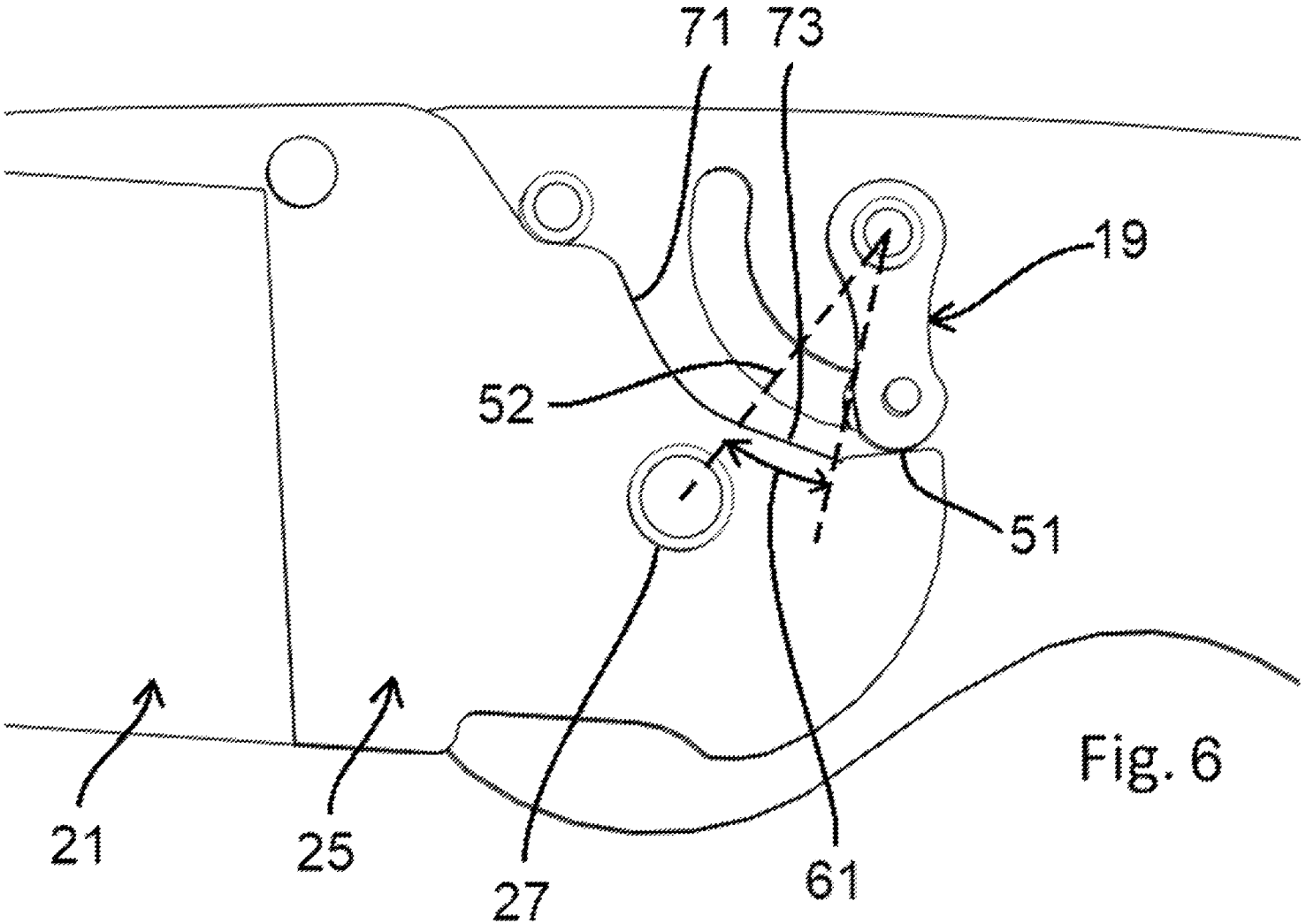
FIGS. 6 and 7 show alternative embodiments of the lock according to this disclosure.
Figure 7:
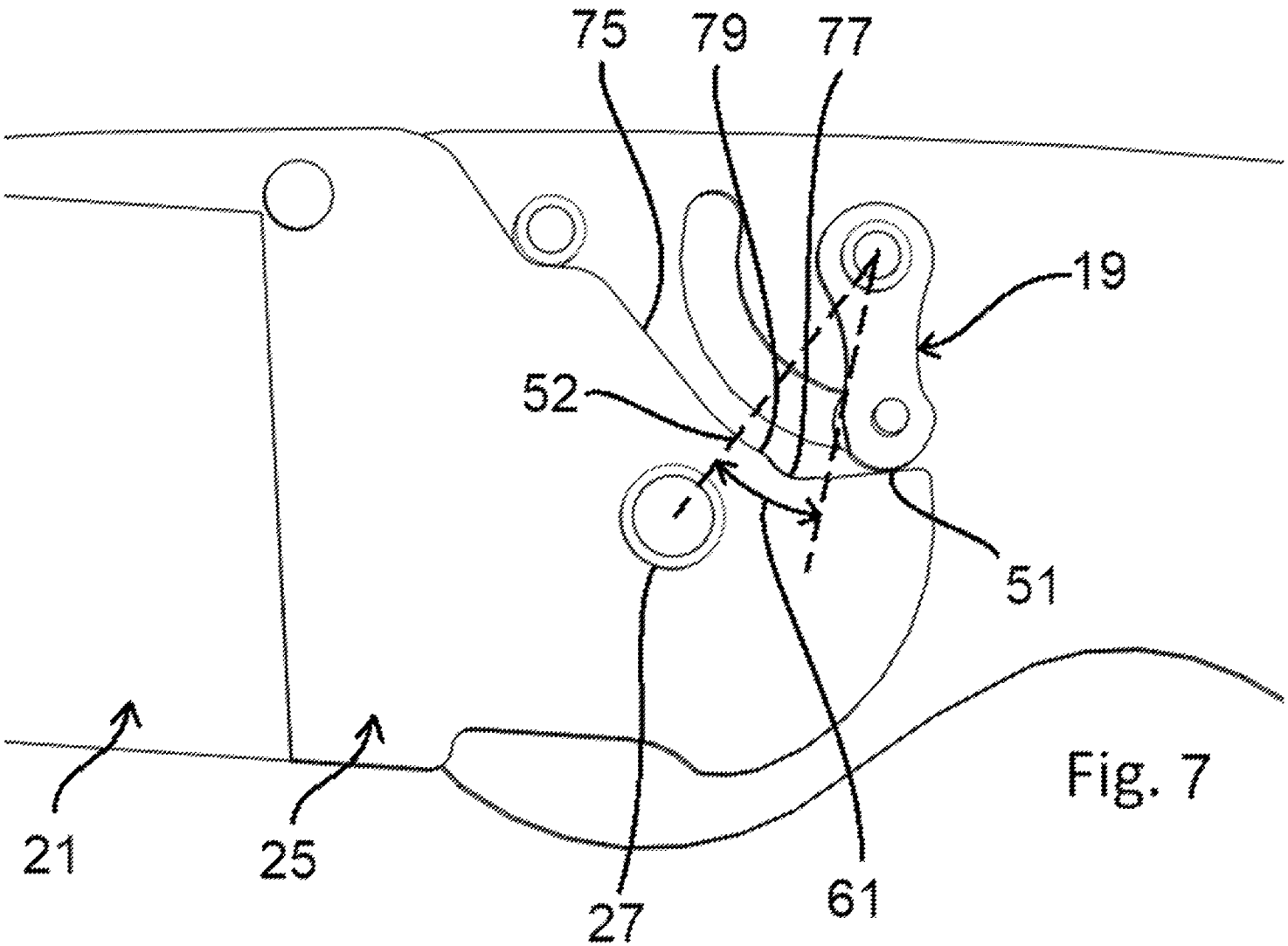

FIGS. 6 and 7 illustrate alternative embodiments of the lock according to this disclosure. In FIG. 6, clearance surface 71 comprises a planar secondary lock face 73 configured to engage lock face 51 when face 51 is within zone 61. In FIG. 7, clearance surface 75 is configured like surface 37 but also comprises a female relief 77, or divot, in secondary lock face 79 that is configured to receive lock face 51 when aligned with relief 77. Relief 77 provides a positive stop during unintentional rotation of the free end of toggle 19 toward fold axis 29.

At least one embodiment is disclosed, and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed. Use of the term "optionally" with respect to any element of a claim means that embodiments with and without the element are within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. A folding knife, comprising:

a handle;

a blade with a working portion and a tang, the blade being coupled to the handle and pivotable relative to the handle about a fold axis between an open position and a closed position;

a toggle coupled to the handle and pivotable relative to the handle about a toggle axis, the toggle axis being located a radial distance from the fold axis, a free end of the toggle having an open lock face located a radial distance from the toggle axis; and a primary lock face on the tang and located on the opposite side of the fold axis from the working portion;

wherein when the blade is in the open position, the open lock face engages the primary lock face to prevent rotation of the blade toward the closed position; and wherein to allow the blade to pivot to the closed position the free end of the toggle must be rotated through an angle sufficient to move the open lock face to the other side of a plane defined by the fold axis and the toggle axis.

2. The knife of claim 1, wherein a forward end of the primary lock face is spaced a radial distance from the fold axis.

3. The knife of claim 1, wherein the primary lock face is planar.

4. The knife of claim 1, wherein the angle is between 5 and 35 degrees.

5. The knife of claim 1, further comprising:

a clearance surface on the tang and extending from the primary lock face to beyond a plane defined by the fold axis and toggle axis.

6. The knife of claim 5, wherein the clearance surface is arcuate.

7. The knife of claim 1, further comprising:

a clearance surface on the tang extending from the primary lock face to at least a plane defined by the fold axis and toggle axis;

wherein a secondary lock face is defined as a portion of the clearance surface between a forward end of the primary lock face and the plane, the secondary lock face being configured to engage the open lock face of the toggle when the open lock face is between the primary lock face and the plane.

8. The knife of claim 7, wherein when the blade is in the open position all portions of the secondary lock face are a radial distance from the toggle axis greater than the distance of the open lock face from the toggle axis.

9. The knife of claim 7, wherein at least a portion of the secondary lock face is arcuate.

10. The knife of claim 7, wherein at least a portion of the secondary lock face is planar.

11. The knife of claim 7, wherein the secondary lock face comprises a female relief configured to receive the open lock face.

12. A folding knife, comprising:

a handle;

a blade with a working portion and a tang, the blade being coupled to the handle and pivotable relative to the handle about a fold axis between an open position and a closed position;

a toggle coupled to the handle and pivotable relative to the handle about a toggle axis, the toggle axis being located a radial distance from the fold axis, a free end of the toggle having an open lock face located a radial distance from the toggle axis;

a primary lock face on the tang and located on the opposite side of the fold axis from the working portion; and a secondary lock face between a forward end of the primary lock face and a plane defined by the fold axis and the toggle axis, the secondary lock face being configured to engage the open lock face of the toggle when the open lock face is between the primary lock face and the plane;

wherein when the blade is in the open position, the open lock face engages the primary lock face to prevent rotation of the blade toward the closed position; and wherein to allow the blade to pivot to the closed position the free end of the toggle must be rotated to move the open lock face to the other side of the plane.

13. The knife of claim 12, wherein a forward end of the primary lock face is spaced a radial distance from the fold axis.

14. The knife of claim 12, wherein the primary lock face is planar.

15. The knife of claim 12, wherein the toggle must be rotated through an angle of between 5 and 35 degrees to move the open lock face from the forward end of the primary lock face to the other side of the plane.

16. The knife of claim 12, wherein when the blade is in the open position all portions of the secondary lock face are a radial distance from the toggle axis greater than the distance of the open lock face from the toggle axis.

17. The knife of claim 12, wherein at least a portion of the secondary lock face is arcuate.

18. The knife of claim 12, wherein at least a portion of the secondary lock face is planar.

19. The knife of claim 12, wherein the secondary lock face comprises a female relief configured to receive the open lock face.

* * * * *